US007310485B2

(12) United States Patent
Peng et al.

(10) Patent No.: US 7,310,485 B2
(45) Date of Patent: Dec. 18, 2007

(54) TEMPERATURE CONTROL OF A FIXING ROLLER IN AN IMAGE FORMING APPARATUS

(75) Inventors: Youbao Peng, Hino (JP); Norio Joichi, Kokubunji (JP); Yoshiki Katayama, Hachioji (JP); Takashi Nara, Niiza (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 249 days.

(21) Appl. No.: 10/942,253

(22) Filed: Sep. 15, 2004

(65) Prior Publication Data

US 2005/0201767 A1 Sep. 15, 2005

(30) Foreign Application Priority Data

Mar. 11, 2004 (JP) ..... 2004-069023

(51) Int. Cl.
*G03G 15/20* (2006.01)

(52) U.S. Cl. ..... 399/69; 399/70; 399/88

(58) Field of Classification Search ..... 399/69, 399/70, 88, 90
See application file for complete search history.

(56) References Cited

U.S. PATENT DOCUMENTS 5,987,275 A * 11/1999 Toyohara et al. ..... 399/70
6,101,346 A * 8/2000 Arakawa ..... 399/70
6,308,022 B1 * 10/2001 Sasai ..... 399/70
6,453,131 B1 * 9/2002 Sasai ..... 399/70
6,810,220 B2 * 10/2004 Hamada et al. ..... 399/69
7,031,630 B2 * 4/2006 Endo ..... 399/70
7,058,331 B2 * 6/2006 Ota ..... 399/70
7,092,652 B2 * 8/2006 Matsumoto ..... 399/70

FOREIGN PATENT DOCUMENTS

JP 62-006287 A 1/1987
JP 1-88964 U 6/1989
JP 11-249491 9/1999
JP 2001-051543 A 2/2001
JP 2002-148994 A 5/2002

* cited by examiner

*Primary Examiner*—William J. Royer
(74) *Attorney, Agent, or Firm*—Frishauf, Holtz, Goodman & Chick, P.C.

(57) ABSTRACT

An image forming apparatus for performing thermal fixing of toner images, including a fixing section, a heating section, a power supply section and a control section. The control section controls the power supplying section to start supplying electric power to the heating section, and the control section controls the power supplying section to stop supplying electric power to the heating section after a lapse of a predetermined time interval, based on a thermal response characteristic of a temperature detecting section, even when the temperature of the heating section has not yet reached a target fixing temperature.

16 Claims, 8 Drawing Sheets

TEMPERATURE CONTROL OF A FIXING ROLLER IN AN IMAGE FORMING APPARATUS

BACKGROUND OF THE INVENTION

The present invention relates to a fixing roller temperature control in an image forming apparatus for heating and fixing a toner image transferred on a recording medium, by means of a fixing roller.

Generally in an image forming apparatus based on an electrophotographic system, extensive use is made of a fixing apparatus provided with a fixing heater roller in contact with one side of an image support and a pressure roller arranged so as to be clamped on the fixing heater roller, so as to ensure that the toner image transferred on one side of the image support (recording medium), such as transfer paper, is thermally fixed on the image support.

In some fixing apparatuses, a heat lamp such as a halogen lamp (hereinafter referred to as "heater") or a heating source based on an induction heating method (heating means) is used to heat the fixing heater roller.

In such a fixing apparatus, a target fixing temperature is preset, and power supply to the aforementioned heating means is controlled so that the temperature of the fixing roller will reach the target fixing temperature. To provide such temperature control, a temperature sensor is arranged close to the fixing roller to detect the temperature of the fixing roller. The temperature sensor has a thermal response characteristic called "responsivity", and has a problem in that it gets the result of measurement after the lapse of a predetermined time interval since it is incapable of providing an instant measurement of the temperature of a subject.

In view of the aforementioned problem of responsivity, the rate of change in the detected temperature, the responsivity (which is a time constant) of the temperature sensor, and the correction rate are added to provide the temperature control of the fixing roller, according to Patent Document 1 identified below.

In Patent Document 2 identified below, the sampling time of the temperature sensor is set to a shorter level when paper is fed, than when paper is not fed, thereby improving temperature control precision.

[Patent Document 1] Official Gazette of Japanese Patent Tokkaihei 5-258761

[Patent Document 2] Official Gazette of Japanese Patent Tokkai 2002-148994

In the temperature control described in Patent Document 1, overshoot can be reduced by correcting the temperature if there is a rise of fixing roller temperature. However, the same correction is also applied when the temperature of the fixing roller falls. Accordingly, an undershoot is produced conversely by the delay of response due to the responsivity of the temperature sensor. Thus, the temperature ripple (the difference between the maximum and minimum values) in temperature control cannot be reduced in total. This has been a problem of this prior art.

In the temperature control described in the aforementioned Patent Document 2, the temperature ripple can be reduced to some extent when the sampling time is set to a shorter level. However, the problem cannot be solved regarding the delay in response due to the responsivity of the temperature sensor. Thus, a great temperature ripple remains without being reduced.

In recent years, an image forming apparatus using the heating means based on the induction heating (IH) system has made its debut on the market. Even if the maximum power of the fixing section is 1000 watts, this image forming apparatus allows the 1000-watt power to be used on either the end or center of the fixed roller. When only the end or the center of the fixed roller is taken into account, the image forming apparatus of this type has a rate of temperature rise equivalent to double the rate of temperature rise of a conventional product. Thus, the impact of the ripple tends to increase.

SUMMARY OF THE INVENTION

To solve the aforementioned problems, an object of the present invention is to provide an image forming apparatus capable of stabilizing the temperature of a fixing roller within the target temperature range by reducing the temperature ripple of the fixing roller noted for a high rate of temperature rise.

According to one aspect of the present invention, an image forming apparatus includes a heating section which heats a fixing roller to provide thermal fixing. A temperature detecting section detects the temperature of the fixing roller. And a control section controls the power supply to the heating section by referring to the temperature detected by the temperature detecting section and so that a temperature of the fixing roller reaches a target fixing temperature. According to this aspect of the present invention, after starting the supply of power to the heating section, the control section stops power supply after the lapse of a predetermined time interval based on the responsivity (the thermal response) of the temperature detecting section, even if the detection temperature has not yet reached the target fixing temperature.

According to another aspect of the present invention, an image forming apparatus includes a first heating section which heats the center of a fixing roller to provide thermal fixing, and a second heating section which heats the ends of the fixing roller. A first temperature detecting section detects the temperature (first detection temperature) at the center of the fixing roller corresponding to the first heating section, and a second heating section, which has a responsivity equivalent to the responsivity of the first temperature detecting section, detects the temperature (second detection temperature) of the ends of the fixing roller corresponding to the second heating section. A control section controls power supply to the first and second heating sections, by referring to the first detection temperature detected by the first temperature detecting section and second detection temperature detected by the second temperature detecting section. According to this aspect of the present invention, after having started power supply to the first and second heating sections, the control section stops power supply after the lapse of a predetermined time interval in accordance with the responsivity of the first and second temperature detecting sections even if the first and second detection temperatures have not yet reached a target fixing temperature.

According to a further aspect of the present invention, an image forming apparatus includes a heating section which heats a fixing roller to provide thermal fixing. A temperature detecting section detects the temperature of the fixing roller. And a control section controls the power supply to the heating section by referring to the temperature detected by the temperature detecting section and so that a temperature of the fixing roller reaches a target fixing temperature.

According to this aspect of the present invention, after having started power supply to the heating section, the control section reduces the amount of power supply in accordance with the responsivity of the temperature detecting section, even if the detection temperature has not yet reached the target fixing temperature, and the control section stops power supply when detection temperature has reached the target fixing temperature.

According to a further aspect of the present invention, an image forming apparatus includes a first heating section which heats the center of a fixing roller to provide thermal fixing, and a second heating section which heats the ends of the fixing roller. A first temperature detecting section detects the temperature (first detection temperature) at the center of the fixing roller corresponding to the first heating section, and a second heating section, which has a responsivity equivalent to the responsivity of the first temperature detecting section, detects the temperature (second detection temperature) of the ends of the fixing roller corresponding to the second heating section. A control section controls power supply to the first and second heating sections, by referring to the first detection temperature detected by the first temperature detecting section and the second detection temperature detected by the second temperature detecting section.

According to this aspect of the present invention, after having started power supply to the first and second heating sections, the control section reduces the amount of the power supply in accordance with the responsivity of the first and second temperature detecting sections, even if the first and second detection temperatures have not yet reached a target fixing temperature, and stops power supply when the temperatures of the first and second temperature detecting section have reached the target fixing temperature.

DETAILED DESCRIPTION OF THE PREFERRED EMBODIMENTS

The following describes the best forms (hereinafter referred to as "embodiments") of practicing the present invention with reference to drawings:

The image forming apparatus of the present embodiment is an image output apparatus (being a copying machine) having a function of copying by reading the contents of a subject to be copied, by means of a document reading device (scanner). The present invention is applicable also to an image output apparatus (printer) not equipped with a document reading device (scanner).

<Embodiment 1>

Figure 1:
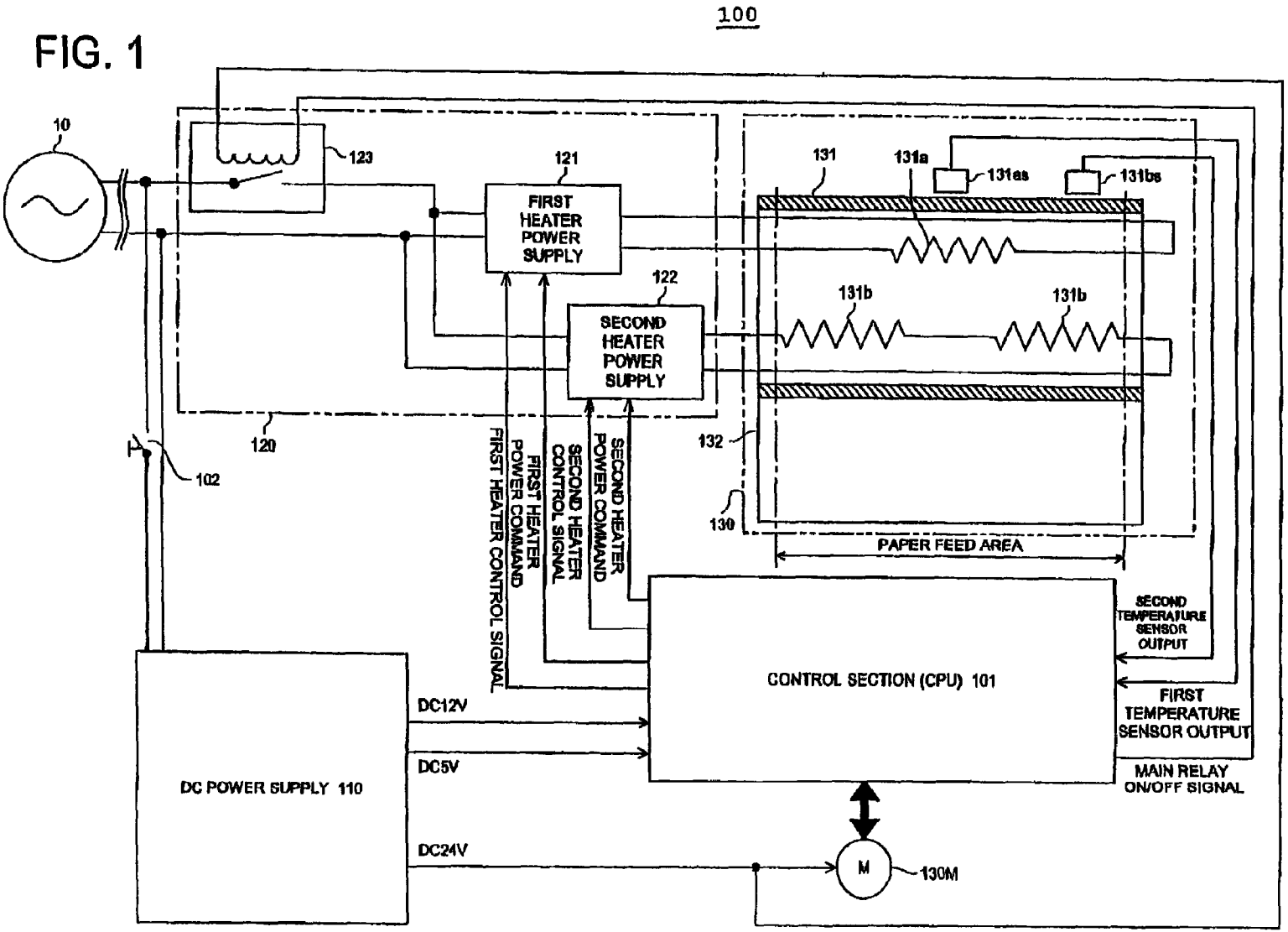
FIG. 1 is a configuration block diagram representing one example of an image forming apparatus as a first embodiment of the present invention.

FIG. 1 is a configuration block diagram representing the circuit of an image forming apparatus as a first embodiment of the present invention. FIG. 1 illustrates the portion (fixing section) required for the explanation of the operation of the present embodiment, and does not contain other commonly known portions.

The image forming apparatus 100 receives power from a commercial power supply 10 of 220 volts a.c. or 200 volts a.c. The alternating current from the commercial power supply 10 is used directly for a fixing apparatus. Further, a d.c. voltage required inside the image forming apparatus is generated and is supplied to various portions. The voltage of the commercial power supply 10 may be slightly different for each country where the image forming apparatus 100 is used.

Numeral 101 indicates a control section including a CPU as control means. By referring to the data of an internal storage section which stores the result of detection by a temperature detecting section, the control section 101 provides control in such a way that power supply is started by a power supply section when a power supply start temperature has been detected.

The control section 101 can be a special-purpose control section for controlling the fixing temperature and power supply, or a control section that provides various types of control for the entire image forming apparatus 100.

Numeral 110 denotes a DC power supply as power supply means, and receives power supplied from the 100-volt or AC 200-volt commercial power supply 10 through a power supply SW 102. The DC power supply 110 generates the d.c. voltage required for the circuit inside the image forming apparatus 100 and for fixing roller motor 130M.

Numeral 120 denotes a fixing power supply section for controlling power supply to a fixing section 130, and includes a first heater power supply 121 for supplying power to a first heater 131*a*, a second heater power supply 122 for supplying power to a second heater 131*b*, and a main relay 123. Here the first heater power supply 121 and second heater power supply 122 are the power supply means for an induction heating method, when the first heater 131*a* and second heater 131*b* are the induction heaters, and the first heater power supply 121 and second heater power supply 122 are the power supply means of switching means, such as an SSR (solid state relay), when the first heater 131*a* and second heater 131*b* are the lamp heaters. The first power supply 121 and second power supply 122 are configured to receive control signals from the control section 101 and to control power supply. The main relay 123 is arranged so to receive a control signal (main relay ON/OFF signal) from the control section 101 and to control switching ON and OFF of power supply to the first heater power supply 121 and second heater power supply 122.

Numeral 130 denotes the fixing section or fixing apparatus for thermal fixing of a toner image transferred on a transfer paper, and includes a fixing roller 131 for thermal fixing and a fixing roller 132 for pressure fixing.

The fixing roller 131 for thermal fixing incorporates the first heater 131*a* as first heating means for heating the central portion of the fixing roller 131, and the second heater 131*b* as second heating means for heating the end of a paper feed portion of the fixing roller 131.

The fixing section 130 incorporates a first temperature sensor 131*as* as first detection temperature means for non-contact detection of the temperature (first detection temperature) at the central portion of the fixing roller 131 corresponding to the first heater 131*a*, and a second temperature sensor 131*bs* as second detection temperature means for non-contact detection of the temperature (second detection temperature) at the end portion of the fixing roller 131 corresponding to the second heater 131*b*. The first temperature sensor 131*as* and second temperature sensor 131*bs* are assumed to have equivalent responsivity. The first temperature sensor 131*as* and second temperature sensor 131*bs* detect the surface temperature of the fixing roller 131 and transmit the result of detection to the control section 101.

The following will omit description of the known configuration of the image forming apparatus 100 up to the process of fixing; namely, configuration for forming an electrostatic latent image on a photoconducting drum (not illustrated), developing the electrostatic latent image using a developing device, forming a toner image, and transferring the toner image on transfer paper.

The operation of the image forming apparatus 100 of the present embodiment configured as described above will be described with reference to the flowchart of FIG. 2, and the with reference to the prior art temperature control characteristics shown in FIG. 3 and the temperature control characteristic according to the present embodiment shown in FIG. 4.

Figure 2:
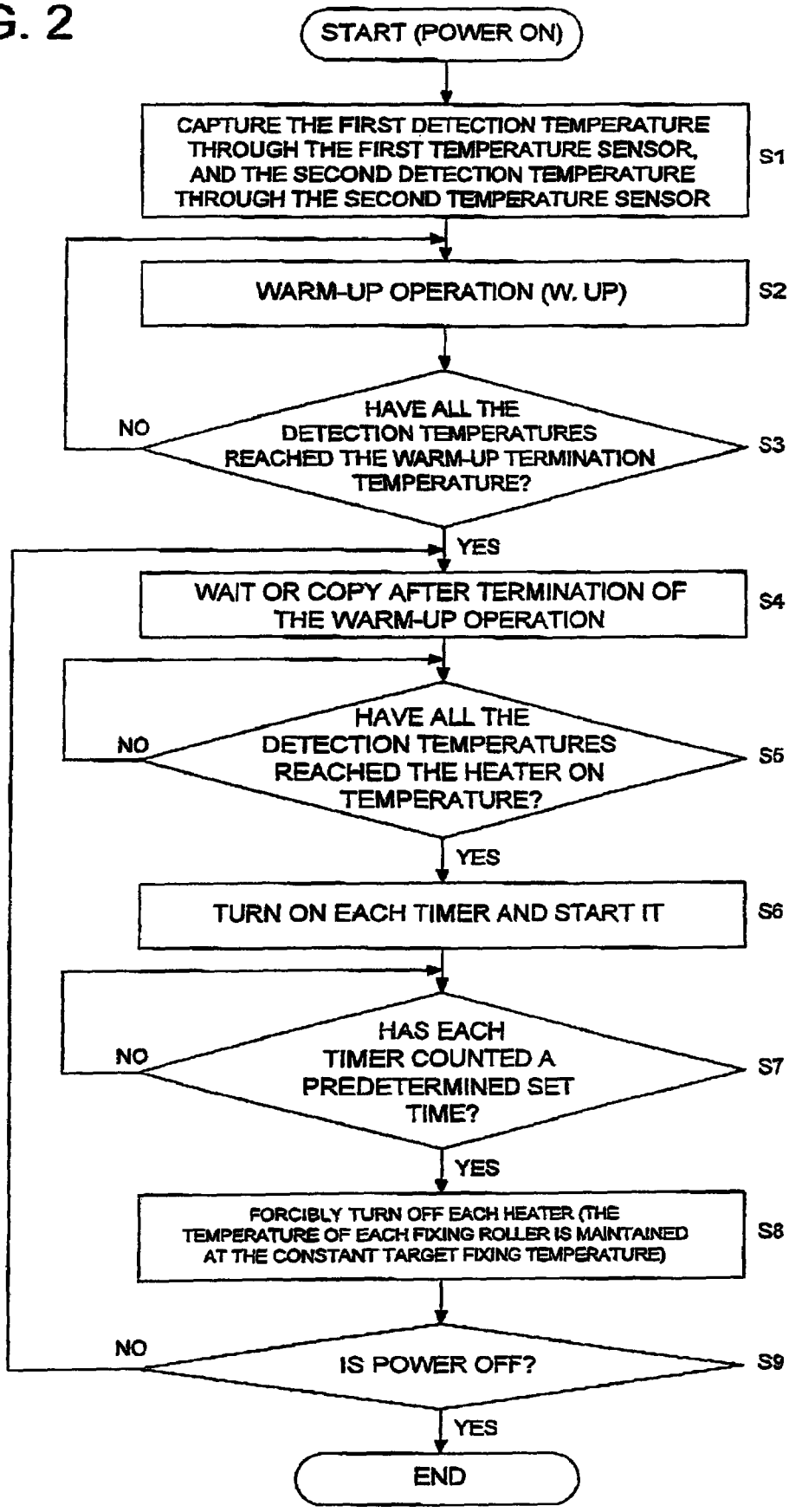
FIG. 2 is a flowchart showing the operation of the image forming apparatus as the first embodiment of the present invention.

Firstly, when the power supply SW 102 of the image forming apparatus 100 is turned on, the control of the flowchart given in FIG. 2 is started by the control section 101.

The control section 101 captures the first detection temperature (temperature at the central portion of the fixing roller 131) by the first temperature sensor 131*as*, and the second detection temperature (temperature at the end of the fixing roller 131) by the second temperature sensor 131*bs* (S1 in FIG. 2).

The control section 101 turns on the main relay 123 (activates it) so that power is supplied to the first heater 131*a* from the first heater power supply 121, and to the second heater 131*b* from the second heater power supply 122; then warm-up operation (W. UP) is performed (S2 in FIG. 2).

The warm-up operation continues until the warm-up termination temperature has been reached by the first heater 131*a* and by the second heater 131*b*, according to the first temperature sensor 131*as* and the second temperature sensor 131*bs*, respectively (S3 in FIG. 2).

The following describes the target temperature (target fixing temperature) of the fixing roller 131, which is 200° C. in the present embodiment, as described below.

According to the prior art temperature control, the warm-up termination temperature for terminating the warm-up operation was the same as the target fixing temperature (200° C.), without any consideration being given to the responsivity of the first temperature sensor 131*as* and second temperature sensor 131*bs*. This results in an increased temperature rise of the fixing roller (overshoot) immediately after termination of the warm-up operation, as shown at (a) in FIG. 3.

In the present embodiment, by contrast, the warm-up termination temperature for terminating the warm-up operation is set at about 196° C., lower than the target fixing temperature (200° C.), with consideration given to the responsivity of the first temperature sensor 131*as* and second temperature sensor 131*bs*.

As described above, the warm-up termination temperature for terminating the warm-up operation is set lower than the target fixing temperature. Accordingly, as shown in at (a) in FIG. 4, this arrangement according to the present embodiment provides more effective control of the temperature rise of the fixing roller (overshoot) immediately after termination of the warm-up operation, as compared to the prior art method (see (a) in FIG. 3). Thus, the present embodiment reduces the temperature ripple of the fixing roller having a high rate of temperature rise, whereby the fixing roller temperature can be stabilized within the range of the target fixing temperature.

When the temperature detected by the first temperature sensor 131*as* and the temperature detected by the second temperature sensor 131*bs* have reached the warm-up termination temperature (Y in S3 of FIG. 2), the control section 101 stops power supply to the first heater 131*a* from the first heater power supply 121, stops power supply to the second heater 131*b* from the second heater power supply 122, and terminates the warm-up operation.

After that, a copying operation starts in response to the operation from the control section (not illustrated), or the waiting state occurs (S4 in FIG. 2).

Here the control section 101 is monitoring the temperature of the fixing roller 131 (S5 of FIG. 2). When the temperature detected by the first temperature sensor 131*as* and the temperature detected by the second temperature sensor 131*bs* have fallen below the heater ON temperature (Y in S5 of FIG. 2), the control section 101 starts the power supply to the first heater 131*a* from the first heater power supply 121 and starts a first timer, and the control section 101 starts the power supply to the second heater 131*b* and starts a second timer (S6 in FIG. 2).

The above description refers to the case where the heater ON temperature is set at 198° C., slightly lower than the target fixing temperature (200° C.). In the present embodiment (FIG. 4), this heater ON temperature is the same as that of the prior art (FIG. 3).

Figure 3:
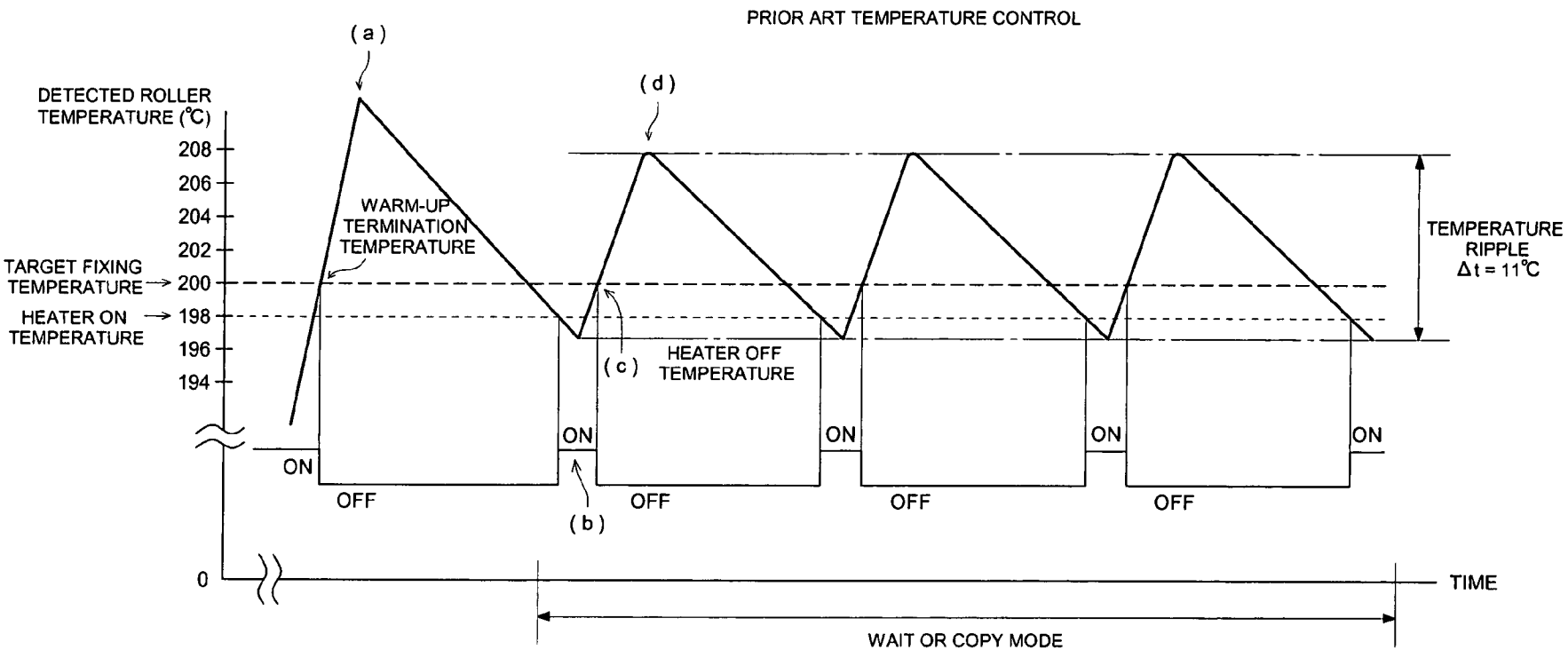
FIG. 3 is a characteristic diagram representing the operation of a prior art image forming apparatus.

Here the setting time "tset" of the above-mentioned first and second timer can be expressed as tset≈t1−td in which the prior art heater ON time (see (b) in FIG. 3) shown in FIG. 3 is assumed as "t1", and the amount of time corresponding to the delay time caused by the responsivity of the first temperature sensor 131*as* and second temperature sensor 131*bs* in the vicinity of the target fixing temperature (200° C.) is assumed as "td".

The control section 101 allows the timer to continue counting until the first and second timers reach the above-mentioned "tset" (S7 in FIG. 2). When the first and second timers have reached the above-mentioned "tset" (Y in S7 of FIG. 2), the control section 101 stops power supply to the first heater 131*a* from the first heater power supply 121, and the control section 101 also stops power supply to the second heater 131*b* from the second heater power supply 122 (S8 in FIG. 2).

To put it another way, the present embodiment is arranged to stop power supply to the first and second heating sections earlier by the time corresponding to the delay time caused by the responsivity of the sensor in the vicinity of the target fixed temperature, even if the detection temperature by the first temperature sensor 131*as* and second temperature sensor 131*bs* has not yet reached the target fixing temperature.

Figure 4:
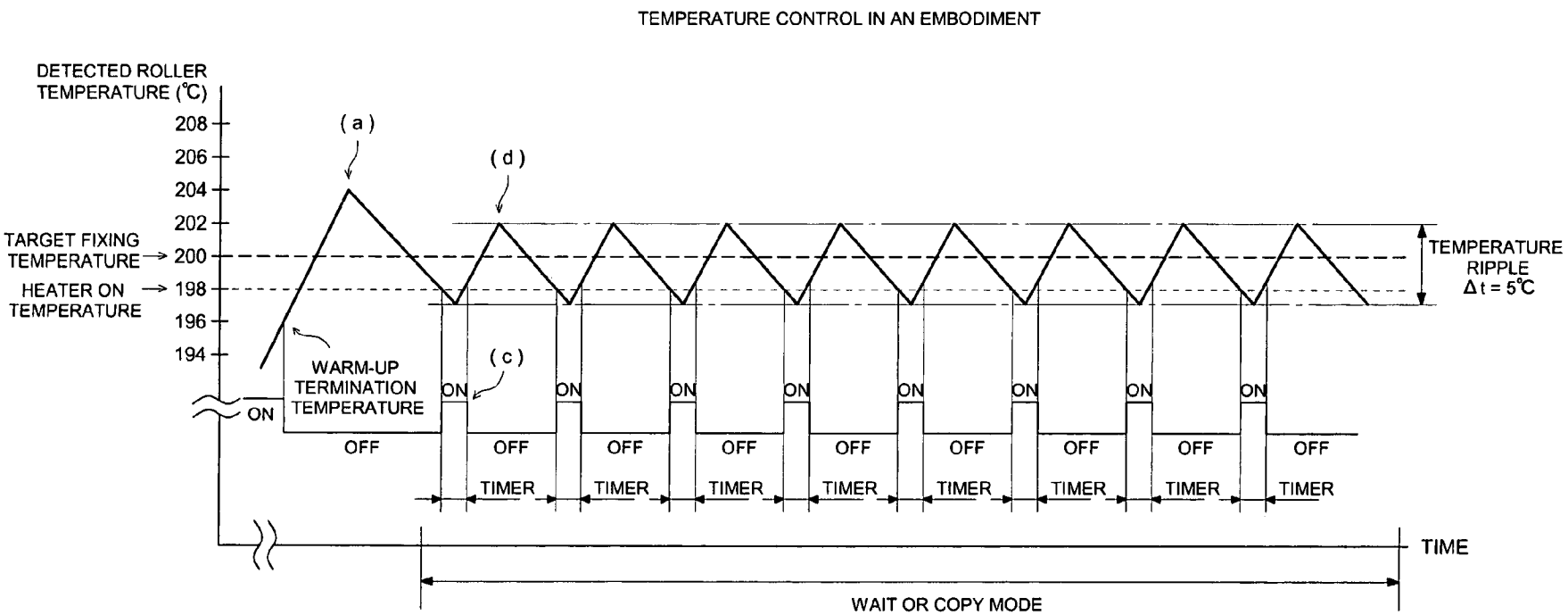
FIG. 4 is a characteristic diagram representing the operation of the image forming apparatus as the first embodiment of the present invention.

As compared with the prior art control method where the power supply is stopped when the sensor has detected the target fixing temperature (see (c) in FIG. 3), the control method of the present embodiment for stopping the power supply earlier by means of a timer (see (c) in FIG. 4) ensures a substantial reduction of the temperature rise (overshoot) of the fixing roller caused by the delay time due to the responsivity of the sensor (see the maximum temperature 209° C. at (d) in FIG. 3 and the maximum temperature 203° C. at (d) in FIG. 4).

As a result, whereas the temperature ripple Δt was 11° C. (198 through 209° C.) in the prior art control method, the temperature ripple Δt can be reduced to 5° C. (198 through 203° C.) in the present embodiment. Thus, the fixing roller temperature can be stabilized within the range of the target fixing temperature.

The control section 101 provides the above-mentioned temperature control (S4 through S8 of FIG. 2) repeatedly until the power supply SW 102 is turned off (Y in S9 of FIG. 2), in such a way that the temperature of the fixing roller 131 will become close to the target fixing temperature.

The inventors of the present invention conducted an experiment, and have found the following: When the prior art heater ON time ((b) in FIG. 3) "t1" was about 3 through 4 seconds, and the responsivity of the first temperature sensor 131*as* and the second temperature sensor 131*bs* was 2±1 sec. (1 through 3 sec.), the time "tset" set on the timer was 0.3 through 1.0 sec. and the temperature ripple Δt was 5° C. The result was more preferable than when the temperature ripple of the prior art control was Δt=11° C. Further, under the same condition, the time "tset" set on the timer was 0.5 through 0.8 sec. Then the temperature ripple Δt was 3° C., and the result was still more preferable than when the temperature ripple of the prior art control was Δt=11° C.

<Embodiment 2>

Figure 5:
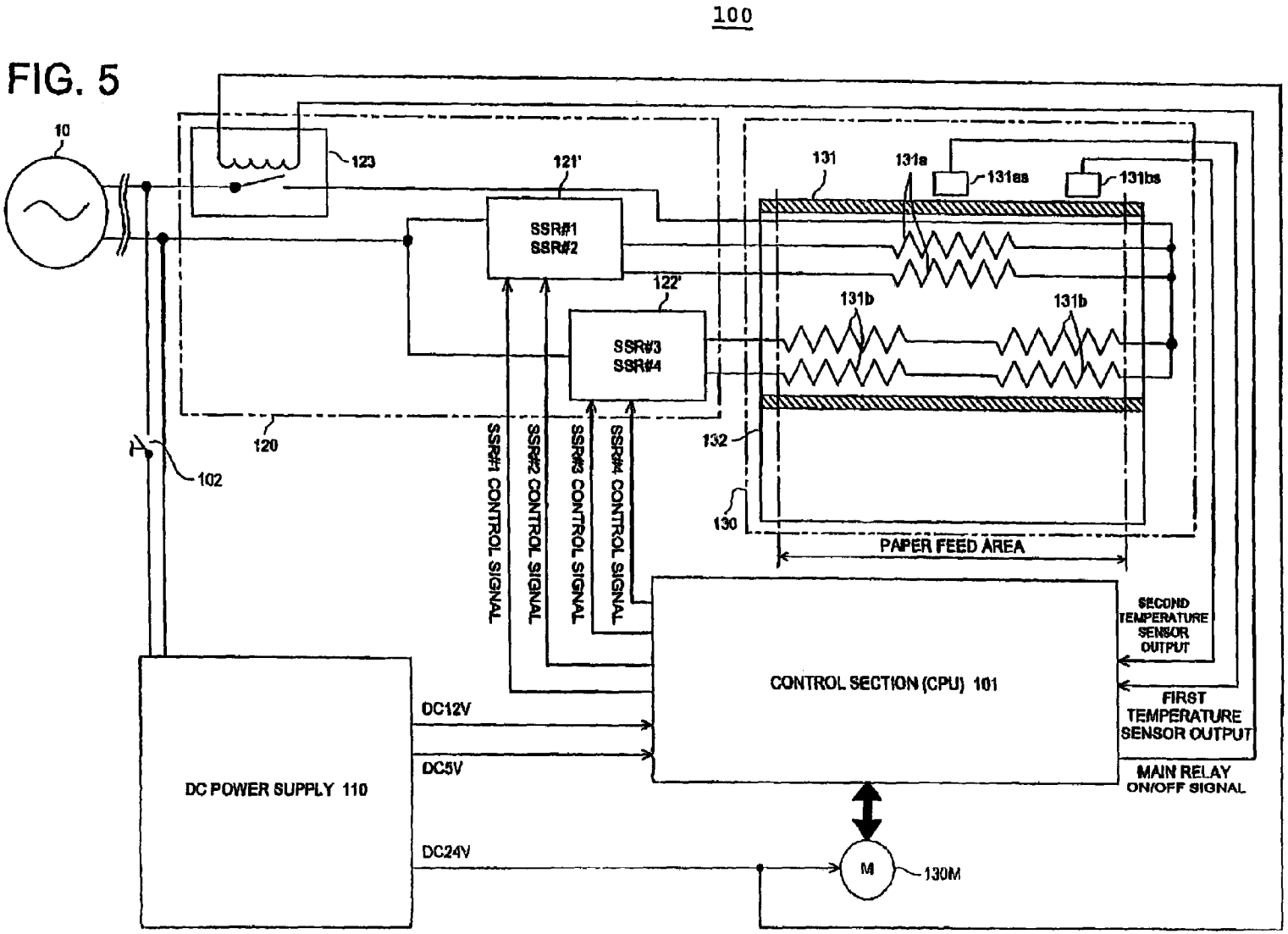
FIG. 5 is a configuration block diagram representing an example of the image forming apparatus as the second embodiment of the present invention.

FIG. 5 is a configuration block diagram representing the image forming apparatus as a second embodiment of the present invention. Similarly to the case of FIG. 1, the portion (fixing section) required for the explanation of the operation of the present embodiment is shown in FIG. 5, and other commonly known portions are omitted.

In the image forming apparatus 100, the difference from the first embodiment is that the first heater 131*a* is made up of two halogen lamps, and each end of the second heater 131*b* is also composed of two halogen lamps.

The first heater power supply 121' for supplying power to the first heater 131*a* provides a switching means such as SSR's (solid state relays), and is composed of SSR#1 and SSR#2 corresponding to two halogen lamps.

The second heater power supply 122' for supplying power to the second heater 131*b* provides a switching means such as SSR's (solid state relays), and is composed of SSR#3 and SSR#4, each corresponding to two halogen lamps.

The configuration other than that described above is basically the same as that of the first embodiment, so the description of duplicated portions will be omitted.

Figure 6:
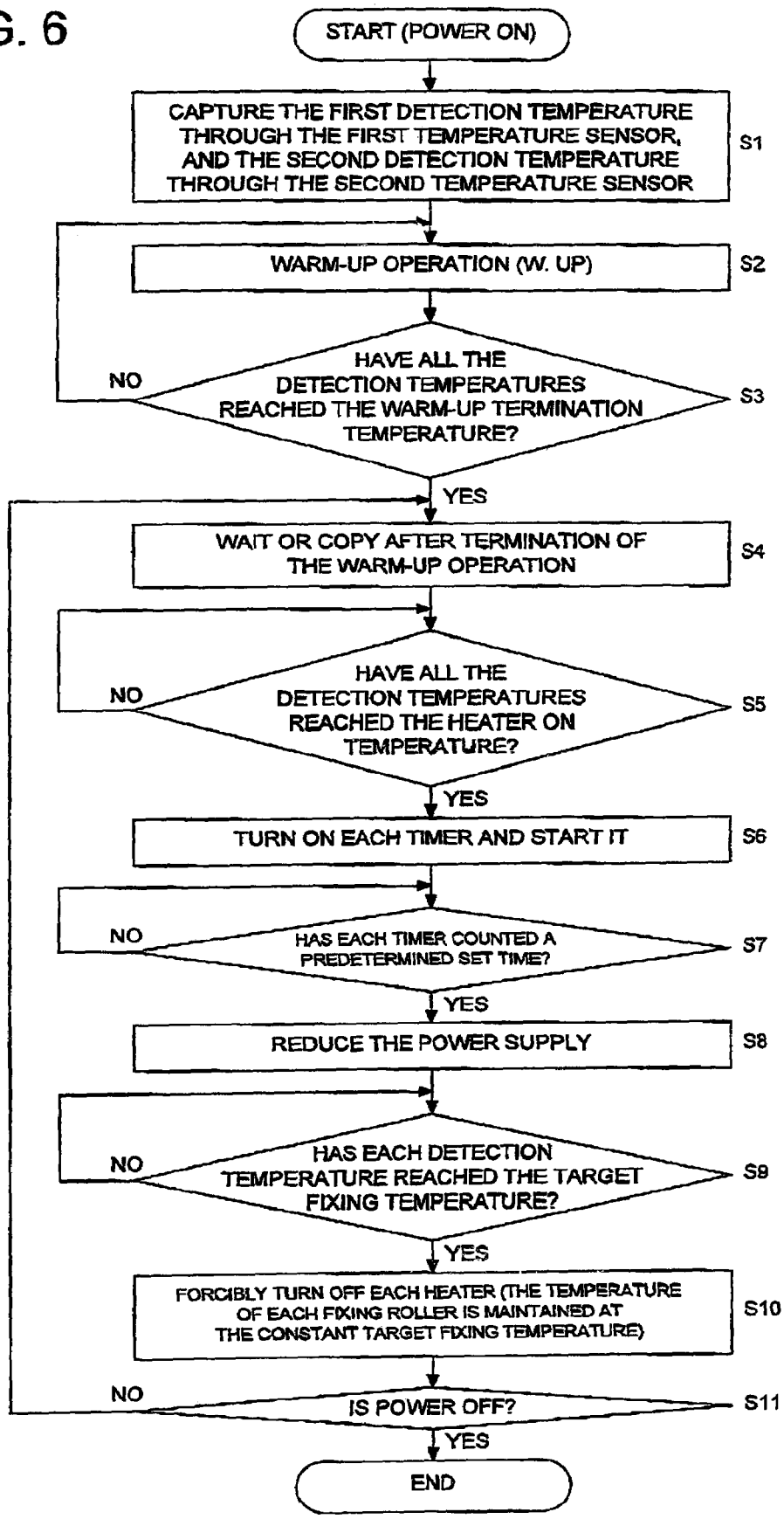
FIG. 6 is a flowchart representing the operation of the image forming apparatus as the second embodiment of the present invention.
Figure 7:
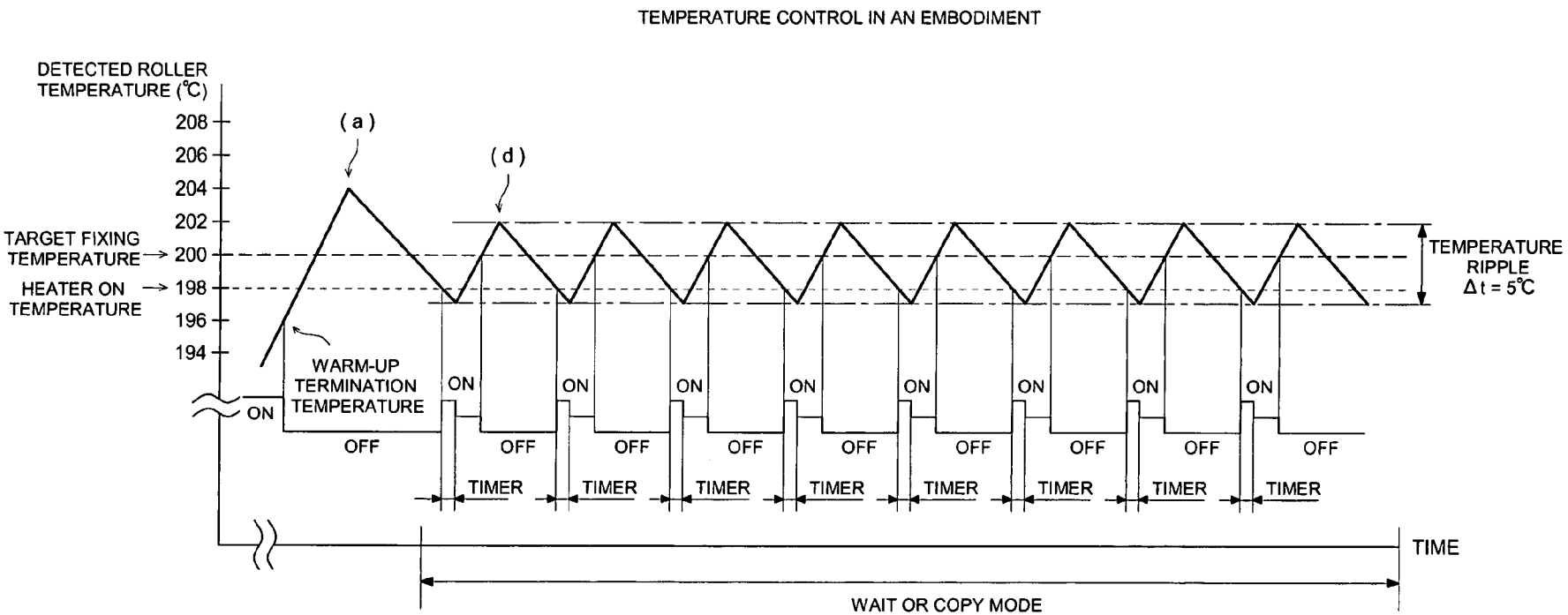
FIG. 7 is a characteristic diagram representing the operation of the image forming apparatus as the second embodiment of the present invention.

The following describes the operation of the image forming apparatus 100 as the present embodiment composed in the above-mentioned manner with reference to the flowchart of FIG. 6 and the temperature control characteristics diagram of FIG. 7.

When the power supply SW 102 of the image forming apparatus 100 has been turned on, the control of the flowchart in FIG. 6 is initiated by the image forming apparatus 100. In the first place, the control section 101 captures the first detection temperature (temperature at the central portion of the fixing roller 131) detected by the first temperature sensor 131*as* and the second detection temperature (temperature at the end of the fixing roller 131) detected by the second temperature sensor 131*bs* (S1 in FIG. 6).

With the main relay 123 turned on (actuated), the control section 101 supplies power to the two halogen lamps of the first heater 131*a* from the first heater power supply 121', and to the two halogen lamps at each end of the second heater 131*b* (a total of four lamps of the second heater 131*b*) from the second heater power supply 122', thereby allowing the warm-up operation (W. UP) to be started (S2 in FIG. 6).

The warm-up operation continues until the warm-up termination temperature has been reached by the first heater 131*a* and by the second heater 131*b*, according to the first temperature sensor 131*as* and the second temperature sensor 131*bs*, respectively (S3 in FIG. 6).

The following describes the target temperature (being the target fixing temperature) of the fixing roller 131 of 200° C. in the present embodiment:

In the present embodiment, the warm-up termination temperature for terminating the warm-up operation is set at about 196° C., lower than the target fixing temperature, with consideration given to the responsivity of the first temperature sensor 131*as* and second temperature sensor 131*bs*.

As described above, the warm-up termination temperature for terminating the warm-up operation is set lower than the target fixing temperature. Accordingly, as shown at (a) in FIG. 7, this arrangement according to the present embodiment provides more effective control of the temperature rise of the fixing roller (overshoot) immediately after termination of the warm-up operation, as compared to the prior art method (see (a) in FIG. 3). Thus, the present embodiment reduces the temperature ripple of the fixing roller having a high rate of temperature rise, whereby the fixing roller temperature can be stabilized within the range of the target fixing temperature.

When the temperature detected by the first temperature sensor 131*as* and the temperature sensor detected by the second temperature sensor 131*bs* have reached the warm-up termination temperature (Y in S3 of FIG. 6), the control section 101 stops power supply to the first heater 131*a* from the first heater power supply 121', stops power supply to the second heater 131*b* from the second heater power supply 122', and terminates the warm-up operation.

After that, a copying operation starts in response to the operation from the control section (not illustrated), or the waiting state occurs (S4 in FIG. 6).

Here the control section 101 is monitoring the temperature of the fixing roller 131 (S5 of FIG. 6).

When the temperature detected by the first temperature sensor 131*as* and the temperature detected by the second temperature sensor 131*bs* have fallen below the heater ON temperature (Y in S5 of FIG. 6), the control section 101 starts the power supply to the two halogen lamps of the first heater 131*a* from the first heater power supply 121' and starts a first timer, and the control section 1010 starts the power supply to the two halogen lamps of each end of the second heater 131*b* from the second heater power supply 122' and starts a second timer (S6 in FIG. 6).

The above description refers to the case where the heater ON temperature is set at 198° C., slightly lower than the target fixing temperature (200° C.). In the present embodiment (FIG. 7), this heater ON temperature is the same as that of the prior art (FIG. 3).

The control section 101 allows the timer to continue counting until the first and second timers reach the above-mentioned "tset" (S7 in FIG. 6). When the first and second timers have reached the above-mentioned "tset" (Y in S7 of FIG. 6), the control section 101 reduces power supply to the first heater 131*a* from the first heater power supply 121', and the control section 101 reduces power supply to the second heater 131*b* from the second heater power supply 122' (S8 in FIG. 6).

In this case, power is reduced in such a way that the power is supplied to only one of the two halogen lamps of the first heater 131*a* from the first heater power supply 121'. In the similar manner, power is reduced in such a way that power is supplied to only two (one lamp on the left end and one lamp in the right end) out of the four halogen lamps of the second heater 131*b* from the second heater power supply 122'.

To put it another way, the present embodiment is arranged to reduce power supply to the first and second heating sections earlier by the time corresponding to the delay time caused by the responsivity of the sensor in the vicinity of the target fixed temperature, even if the detection temperature by the first temperature sensor 131*as* and second temperature sensor 131*bs* has not yet reached the target fixing temperature.

The control section 101 monitors the temperature of the fixing roller 131 (S9 in FIG. 6). When the temperature detected by the first temperature sensor 131*as* and the temperature detected by the second temperature sensor 131*bs* have reached the target fixing temperature (Y in S9 of FIG. 6), the control section 101 stops power supply to the first heater 131*a* from the first heater power supply 121', and the control section 101 stops power supply to the second heater 131*b* from the second heater power supply 122' (S10 in FIG. 2).

Means are provided to ensure that power supply to the first and second heaters 131*a* and 131*b* is stopped, when the detection temperature of the first temperature sensor 131*as* and second temperature sensor 131*bs* has reached the target fixing temperature after the supply power has been reduced.

Thus, as compared to the prior art method of supplying 100 percent power until the sensor detects the target fixing temperature (see (c) in FIG. 3), the control method of the present embodiment for reducing the power supply earlier by means of a timer and stopping the power supply when the target fixing temperature has been reached after the reduction of the power supply ensures a substantial reduction of the temperature rise (overshoot) of the fixing roller caused by the delay time due to the responsivity of the sensor (see the maximum temperature 209° C. at (d) in FIG. 3 and the maximum temperature of 202 through 203° C. at (d) in FIG. 7).

As a result, whereas the temperature ripple Δt was 11° C. (198 through 209° C.) for the fixing roller having a high rate of temperature rise in the prior art control method, the temperature ripple Δt can be reduced to 4 through 5° C. (198 through 202 or 203° C.) in the present embodiment. Thus, the fixing roller temperature can be stabilized within the range of the target fixing temperature.

The control section 101 provides the above-mentioned temperature control (S4 through S10 in FIG. 6) repeatedly until the power supply SW 102 is turned off (Y in S11 of FIG. 6), in such a way that the temperature of the fixing roller 131 will become close to the target fixing temperature.

In the above-mentioned description, power is reduced using one of two halogen lamps of the first heater 131*a* and two of four lamps of the second heater 131*b* as one set. Power supply may be reduced using different numbers of halogen lamps. Further, power supply may be reduced using the heating source of induction heating method.

In the above-mentioned embodiments, it is possible to arrange such a configuration that the control section 101 adjusts the above-mentioned "tset" so that the period of suspending power supply is maximal. Here a long period of suspending power supply indicates that temperature rise is gradual. If the "tset" can be adjusted in this manner, the temperature ripple can be reduced and more preferred temperature control can be ensured.

<Embodiment 3>

The first power supply time period (tset1) from the start of power supply to the first heater 131*a* to the stop of power supply or power reduction is preferred to be determined in response to responsivity of the first temperature sensor 131*as*. The second power supply time period (tset2) from the start of power supply to the second heater 131*b* to the stop of power supply or power reduction is preferred to be determined in response to responsivity of the second temperature sensor 131*bs*.

In addition to the above, it is more preferred that the aforementioned tset1 and tset2 be determined independently of each other, according to whether the fixing roller 131 is rotated or not. To put it another way, the first power supply time period tset1' when the fixing roller is rotating, the second power supply time period tset2' when the fixing roller is rotating, the first power supply time period tset1" when the fixing roller is not rotating, and the second power supply time period tset2" when the fixing roller is not rotating are determined.

In this case, the time of rotation of the fixing roller 131 often corresponds to the image forming period for fixing on recording paper. It is preferred to determine the first power supply time period tset1' during rotation of the fixing roller and the second power supply time period tset2' during rotation of the fixing roller, which are suitable for fixing.

The time when the fixing roller 131 is not rotating corresponds to the time when fixing is not performed. It is preferred to determine the first power supply time period tset1" during non-rotation of the fixing roller and the second power supply time period tset2" during non-rotation of the fixing roller, which are suitable for fixing.

This arrangement provides more effective control of the temperature rise of the fixing roller (overshoot) caused by the delay time resulting from the responsivity of each of the first temperature sensor 131*as* and second temperature sensor 131*bs*, including the rotation or non-rotation of the fixing roller 131. The arrangement also reduces the temperature ripple of the fixing roller having a high rate of temperature rise, whereby the fixing roller temperature can be stabilized within the range of the target fixing temperature.

<Embodiment 4>

Figure 8:
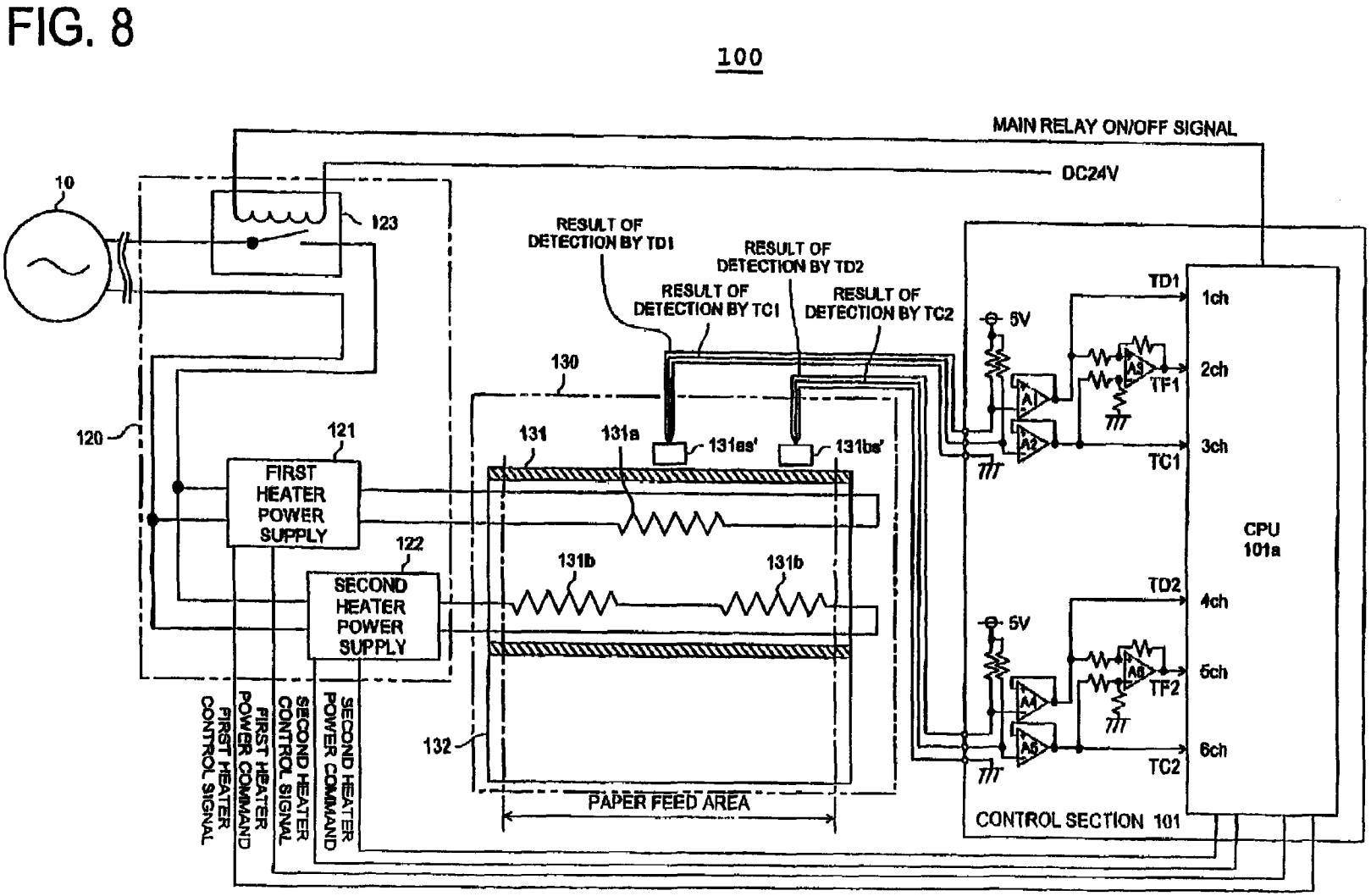
FIG. 8 is a characteristic diagram representing an example of major portions of the image forming apparatus as the third embodiment of the present invention.

FIG. 8 is a characteristic diagram representing the circuit configuration in an image forming apparatus as the fourth embodiment of the present invention. Similarly to the case of FIGS. 1 and 5, FIG. 8 illustrates the portion (fixing section) required for the explanation of the operation of the present embodiment, and does not contain other commonly known portions.

The difference of in image forming apparatus 100 according to the fourth embodiment from that of the first embodiment is that the first temperature sensor 131*as*" contains an infrared ray temperature sensor (TD1) for detecting the infrared ray emitted from the fixing roller 131, and a temperature correction sensor (TC1) for correcting the temperature by detecting the temperature around the infrared temperature sensor. In a similar manner, the second temperature sensor 131*bs*' contains an infrared ray temperature sensor (TD2) for detecting the infrared ray emitted from the fixing roller 131, and a temperature correction sensor (TC2) for correcting the temperature by detecting the temperature around the infrared temperature sensor.

The control section 101 incorporates;

a buffer amplifier A1 for amplifying the result of detection by the infrared ray temperature sensor (TD1);

a buffer amplifier A2 for amplifying the result of detection by the temperature correction sensor (TC1); and a differential amplifier A3 for creating the TF1 by amplifying the difference in potentials between the amplified signal (output A1) resulting from the detection by the infrared ray temperature sensor (TD1), and the amplified signal (output A2) resulting from the detection by the temperature correction sensor (TC1). In the similar manner, the control section 101 also incorporate's:

a buffer amplifier A4 for amplifying the result of detection by the infrared ray temperature sensor (TD2);

a buffer amplifier A5 for amplifying the result of detection by the temperature correction sensor (TC2); and a differential amplifier A6 for creating the TF2 by amplifying the difference in potentials between the amplified signal (output A4) resulting from the detection by the infrared ray temperature sensor (TD2), and the amplified signal (output A5) resulting from the detection by the temperature correction sensor (TC2).

The output from the buffer amplifier A1, the output from the buffer amplifier A2, the output from the differential amplifier A3, the output from the buffer amplifier A4, the output from the buffer amplifier A5 and the output from the differential amplifier A6 are supplied to the input port of the CPU 101*a* in the control section 101. In this case, the buffer amplifier A1, the buffer amplifier A2, the differential amplifier A3, buffer amplifier A4, the buffer amplifier A5, differential amplifier A6 and CPU 101*a* constitute a temperature calculation section according to the present invention.

In the aforementioned configuration, the CPU 101*a* calculates the surface temperature at the central portion of the fixing roller 131 that is corrected for temperature, from the TF1 equivalent to the potential difference between the result of detection by the infrared ray temperature sensor TD1 and the result of detection by the temperature correction sensor TC1. In the similar manner, the CPU 101*a* calculates the surface temperature at the end portion of the fixing roller 131 that is corrected for temperature, from the TF2 equivalent to the potential difference between the result of detection by the infrared ray temperature sensor TD2 and the result of detection by the temperature correction sensor TC2.

The configuration of the fourth embodiment, other than as described above, is basically the same as the configuration of the first embodiment, so the description of duplicated portions will be omitted.

The image forming apparatus 100 of the present embodiment configured as described above contains the infrared temperature sensor for detecting the infrared ray emitted from the fixing roller 131. This arrangement permits comparatively precise detection of the temperature rise in the fixing roller 131 and provides more effective control of the temperature rise (overshoot) of the fixing roller 131. The arrangement also reduces the temperature ripple of the fixing roller having a high rate of temperature rise, whereby the fixing roller temperature can be stabilized within the range of the target fixing temperature.

When the infrared temperature sensor and temperature correction sensor are used, the CPU 101*a* calculates the temperature of the fixing roller 131 after capturing the results of a predetermined number of detections by the infrared temperature sensor and temperature correction sensor, and averaging these results.

In this case, a predetermined number of detections used for averaging should preferably be set at a smaller value when the fixing roller is rotating than when it is not rotating. This arrangement makes it possible to conform to an abrupt change, and reduces the temperature ripple of the fixing roller having a high rate of temperature rise, whereby the fixing roller temperature can be stabilized within the range of the target fixing temperature.

As described above, when the temperature of the fixing roller 131 is calculated by averaging a predetermined number of detections, the predetermined number of detections used for averaging should preferably be set at a smaller value when high power is supplied, than when low power is supplied. Here the "high power" in the above-mentioned description can be defined as the higher power when different powers in different phases are supplied, whereas the "low power" is the lower power in the same situation. To put it another way, when high power is supplied, temperature tends to increase, and high power is supplied for feeding the recording paper or the like. Accordingly, heat tends to be absorbed by the recording paper, and temperature tends to decrease. Thus, this arrangement makes it possible to conform to the abrupt change in the fixing roller temperature, and reduces the temperature ripple of the fixing roller having a high rate of temperature rise, whereby the fixing roller temperature can be stabilized within the range of the target fixing temperature.

<Other Embodiments>

In addition to such heater lamps as halogen lamps, the heating source (heating means) based on induction heating (IH) method can be used as the first heater 131*a* and second heater 131*b* in each of the aforementioned embodiments. When the heating source (heating means) based on induction-heating (IH) method is used, the heating means based on induction heating method is employed as the first heater power supply 121 and second heater power supply 122.

In this case, it is possible to arrange such a configuration that the maximum power available for thermal fixing (e.g. 1000 watts) can be produced independently by either the first heater 131*a* or second heater 131*b*. When the maximum available power for thermal fixing (1000 watts) is supplied to either one of the first heater 131*a* or second heater 131*b*, the control section 101 provides control in such a way that power is not supplied to the other. It is also possible to supply power of 500 watts+500 watts, for example, by the first heater 131*a* and second heater 131*b*, in a similar manner to the case of the prior art.

This structure of the present invention, in which the maximum power available for the thermal fixing is produced independently by either the first heater 131*a* or second heater 131*b* (1000 W+0 W, or 0 W+1000 W) is placed under a condition equivalent to the case where the heat source has a capacity twice as much as that of the conventional 500 W+500 W, even if locally, and the rate of temperature rise is increased. This may raise concerns over the possibility of causing a temperature ripple. However, application of the aforementioned first through fourth embodiments reduces the temperature ripple, even for the fixing roller having a high rate of temperature rise, due to heating by the maximum power supply based on the electromagnetic induction heating method, whereby the fixing roller temperature can be stabilized within the range of the target fixing temperature.

In view of the foregoing description of the present invention, the following structures and advantages can be achieved, for example, according to the present invention.

(1) The present invention described in Structure 1 is an image forming apparatus, for providing thermal fixing of a toner image transferred on a recording medium, including:

a heating section for heating a fixing roller to provide thermal fixing;

a temperature detecting section for detecting the temperature of the fixing roller corresponding to the heating section; and a control section for controlling the power supply to the heating section by referencing the detection temperature detected by the temperature detecting section and for controlling the fixing roller so that its temperature reaches the target fixing temperature.

This image forming apparatus is further characterized in that, after starting the supply of power to the heating section, the control section stops power supply after the lapse of a predetermined time interval based on the responsivity (being the thermal response) of the temperature detecting section, even if the detection temperature has not yet reached the target fixing temperature.

(2) The present invention described in Structure 2 is an image forming apparatus, for providing thermal fixing of a toner image transferred on a recording medium, including:

a first heating section for heating the center of a fixing roller to provide thermal fixing;

a second heating section for heating the ends of the fixing roller;

a first temperature detecting section for detecting the temperature (first detection temperature) at the center of the fixing roller corresponding to the first heating section;

a second heating section, having the responsivity equivalent to that of the first temperature detecting section, for detecting the temperature (second detection temperature) of the ends of the fixing roller corresponding to the second heating section;

a control section for controlling power supply to the first and second heating sections, by referencing the first detection temperature detected by the first temperature detecting section and second detection temperature detected by the second temperature detecting section.

This image forming apparatus is further characterized in that, after having started power supply to the first and second heating sections, the control section stops power supply after the lapse of a predetermined time interval in conformity to the responsivity of the first and second temperature detecting sections even if the first and second detection temperatures have not yet reached the target fixing temperature.

(3) The present invention described in Structure 3 is an image forming apparatus, for providing thermal fixing of a toner image transferred on a recording medium, including:

a heating section for heating a fixing roller to provide thermal fixing;

a temperature detecting section for detecting the temperature of the fixing roller corresponding to the heating section; and a control section for controlling the power supply to the heating section by referencing the detection temperature detected by the temperature detecting section and for controlling the fixing roller so that its temperature reaches the target fixing temperature.

This image forming apparatus is further characterized in that the control section reduces the amount of power supply in conformity to the responsivity of the temperature detecting section, even if the detection temperature has not yet reached the target fixing temperature, and stops power supply when detection temperature has reached the target fixing temperature.

(4) The present invention described in Structure 4 is an image forming apparatus, for providing thermal fixing of a toner image transferred on a recording medium, including:

a first heating section for heating the center of a fixing roller to provide thermal fixing;

a second heating section for heating the ends of the fixing roller;

a first temperature detecting section for detecting the temperature (first detection temperature) at the center of the fixing roller corresponding to the first heating section;

a second heating section, having the responsivity equivalent to that of the first temperature detecting section, for detecting the temperature (second detection temperature) of the ends of the fixing roller corresponding to the second heating section;

a control section for controlling power supply to the first and second heating sections, by referencing the first detection temperature detected by the first temperature detecting section and second detection temperature detected by the second temperature detecting section.

This image forming apparatus is further characterized in that, after having started power supply to the first and second heating sections, the control section reduces the amount of the power supply in conformity to the responsivity of the first and second temperature detecting sections, even if the first and second detection temperatures have not yet reached the target fixing temperature, and stops power supply when the temperatures of the first and second temperature detecting sections have reached the target fixing temperature.

(5) The present invention described in Structure 5 is the image forming apparatus given in Structures 2 or 4 wherein the first power supply time period from the start of power supply to the first heating means to the stop the supply or reduce the amount of supply is determined in conformity to the responsivity of the first temperature detecting section, and the second power supply time period from the start of power supply to the second heating means to the stop the supply or reduce the amount of supply is determined in conformity to the responsivity of the second temperature detecting section; wherein the first power supply time period when the fixing roller is rotating, the second power supply time period when the fixing roller is rotating, the first power supply time period when the fixing roller is not rotating, and the second power supply time period when the fixing roller is not rotating are determined, depending on whether the fixing roller rotates or not.

(6) The present invention described in Structure 6 is the image forming apparatus given in Structures 1 through 5, wherein the warm-up termination temperature for terminating the warm-up operation is set to be lower than the target fixing temperature.

(7) The present invention described in Structure 7 is the image forming apparatus given in Structures 1 through 6, wherein the temperature detecting section comprises:

an infrared temperature sensor for detecting the infrared ray radiated from the fixing roller;

a temperature correction sensor for providing temperature correction by detecting the temperature around the infrared temperature sensor; and a temperature calculation section for calculating the temperature of the fixing roller from the result of detection by the infrared temperature sensor and that of the temperature correction sensor.

(8) The present invention described in Structure 8 is the image forming apparatus given in Structure 7, wherein the temperature calculation section calculates the fixed roller temperature from the result gained by averaging the results of a predetermined number of detections obtained by reading the infrared temperature sensor at certain intervals and the result gained by averaging the results of a predetermined number of detections obtained by reading the temperature correction sensor at certain intervals; and a predetermined number of detections used for the aforementioned averaging is set at a smaller value when the fixing roller is rotating, than when the fixing roller is not rotating.

(9) The present invention described in Structure 9 is the image forming apparatus given in Structures 7 or 8, wherein the temperature calculation section calculates the fixed roller temperature from the result gained by averaging the results of a predetermined number of detections obtained by reading the infrared temperature sensor at certain intervals and the result gained by averaging the results of a predetermined number of detections obtained by reading the temperature correction sensor at certain intervals; and a predetermined number of detections used for the aforementioned averaging is set at a smaller value when high power is supplied to the heating section, than when low power is supplied.

(10) The present invention described in Structure 10 is the image forming apparatus given in Structures 2 or 4 wherein the first and second heating sections are heating units based on electromagnetic induction heating; the maximum power available for thermal fixing can be produced independently by either the first or second heating section; and, when the maximum power available for thermal fixing is supplied to either one of the first and second heating sections, the aforementioned control section does not supply it to the other.

The present invention provides the following advantages:

(1) In the present invention described in Structure 1, the power supply to the heating section is controlled by referencing the detection temperature of a fixing roller to ensure that the fixing roller temperature reaches a predetermined target fixing temperature. In this case, control is provided after starting the supply of power to the heating section, in such a way that power supply is stopped after the lapse of a predetermined time interval, in conformity to the responsivity of the temperature detecting section, even if the detection temperature has not yet reached the target fixing temperature.

In this case, it is preferred to stop power supply to the heating section earlier by the time corresponding to the delay time caused by the responsivity of the temperature detecting section in the vicinity of the target fixed temperature. Thus, as compared with the case where the power supply is stopped when the temperature detecting section has detected the target fixing temperature, it is possible to reduce the temperature rise (being an overshoot) of the fixing roller caused by the delay time resulting from the responsivity of the temperature detecting section, and to reduce the temperature ripple of the fixing roller having a high rate of temperature rise, whereby the fixing roller temperature can be stabilized within the range of the target fixing temperature.

(2) In the present invention described in Structure 2, the power supply to the first and second heating sections is controlled by referencing the first detection temperature detected by the first temperature detecting section and second detection temperature detected by the second temperature detecting section, and control is provided in such a way that the fixing roller temperature reaches a predetermined target fixing temperature. In this case, after having started power supply to the first and second heating sections, the control section stops power supply after the lapse of a predetermined time interval in conformity to the responsivity of the first and second temperature detecting sections even if the first and second detection temperatures have not yet reached the target fixing temperature.

In the above-mentioned case, it is preferred to stop power supply to the first heating section earlier by the time corresponding to the delay time caused by the responsivity of the first temperature detecting section in the vicinity of the target fixed temperature. Further, it is also preferred to stop power supply to the second heating section earlier by the time corresponding to the delay time caused by the responsivity of the second temperature detecting section in the vicinity of the target fixing temperature.

Thus, as compared with the case where the power supply is stopped when the first and second temperature detecting sections have detected the target fixing temperature, it is possible to reduce the temperature rise (overshoot) of the fixing roller caused by the delay time resulting from the responsivity of the first and second temperature detecting sections, and to reduce the temperature ripple of the fixing roller having a high rate of temperature rise, whereby the fixing roller temperature can be stabilized within the range of the target fixing temperature.

(3) In the present invention described in Structure 3, the power supply to the heating section is controlled by referencing the detection temperature detected by the temperature detecting section, and control is provided in such a way that the fixing roller temperature reaches a predetermined target fixing temperature. In this case, after having started power supply to the heating section, control is provided to reduce the amount of power supply in conformity to the responsivity of the temperature detecting section, even if the detection temperature has not yet reached the target fixing temperature, and stops power supply when detection temperature has reached the target fixing temperature.

In the above-mentioned case, it is preferred to stop power supply to the heating section earlier by the time corresponding to the delay time caused by the responsivity of the temperature detecting section in the vicinity of the target fixed temperature. Thus, as compared with the case where the power supply is continued until the target fixing temperature is detected by the temperature detecting section, it is possible to reduce the temperature rise (overshoot) of the fixing roller caused by the delay time resulting from the responsivity of the temperature detecting sections, and to reduce the temperature ripple of the fixing roller having a high rate of temperature rise, whereby the fixing roller temperature can be stabilized within the range of the target fixing temperature.

(4) In the present invention described in Structure 4, power supply to the first and second heating sections is controlled by referencing the first detection temperature detected by the first temperature detecting section and second detection temperature detected by the second temperature detecting section, and control is provided in such a way that the fixing roller temperature reaches the target fixing temperature. In this case, after having started power supply to the first and second heating sections, control is provided to reduce the amount of the power supply after the lapse of a predetermined time interval, in conformity to the responsivity of the first and second temperature detecting sections, even if the first and second detection temperatures have not yet reached the target fixing temperature, and stops power supply when the temperatures of the first and second temperature detecting sections have reached the target fixing temperature.

In the above-mentioned instance, it is preferred to stop power supply to the first heating section earlier by the time corresponding to the delay time caused by the responsivity of the first temperature detecting section in the vicinity of the target fixed temperature. Further, it is also preferred to stop power supply to the second heating section earlier by the time corresponding to the delay time caused by the responsivity of the second temperature detecting section in the vicinity of the target fixing temperature.

Thus, as compared with the case where the power supply is continued until the target fixing temperature is detected by the first and second temperature detecting sections, it is possible to reduce the temperature rise (overshoot) of the fixing roller caused by the delay time resulting from the responsivity of each of the first and second temperature detecting sections, and to reduce the temperature ripple of the fixing roller having a high rate of temperature rise, whereby the fixing roller temperature can be stabilized within the range of the target fixing temperature.

(5) In the present invention described in Structure 5, the first power supply time period is determined in conformity to the responsivity of the first temperature detecting section, and the second power supply time period is determined in conformity to the responsivity of the second temperature detecting section. Further, the first power supply time period when the fixing roller is rotating, the second power supply time period when the fixing roller is rotating, the first power supply time period when the fixing roller is not rotating, and the second power supply time period when the fixing roller is not rotating are determined, depending on whether the fixing roller rotates or not.

Thus, this arrangement effectively reduces the temperature rise (overshoot) of the fixing roller caused by the delay time resulting from the responsivity of each of the first and second temperature detecting sections, regardless of whether the fixing roller is rotating or not, and also reduces the temperature ripple of the fixing roller having a high rate of temperature rise, whereby the fixing roller temperature can be stabilized within the range of the target fixing temperature.

(6) In the present invention described in Structure 6, the warm-up termination temperature for terminating the warm-up operation is set to be lower than the target fixing temperature. This arrangement effectively reduces the temperature rise (overshoot) of the fixing roller immediately after termination of warm-up operation, and also reduces the temperature ripple of the fixing roller having a high rate of temperature rise, whereby the fixing roller temperature can be stabilized within the range of the target fixing temperature.

(7) In the present invention described in Structure 7, the temperature detecting section comprises an infrared temperature sensor for detecting the infrared ray radiated from the fixing roller. This arrangement allows earlier detection of the temperature rise of the fixing roller, and more effectively reduces the temperature rise (overshoot) of the fixing roller in Structures (1) through (6). This arrangement also reduces the temperature ripple of the fixing roller having a high rate of temperature rise, whereby the fixing roller temperature can be stabilized within the range of the target fixing temperature.

(8) In the present invention described in Structure 8, the temperature calculation section calculates the temperature by averaging the results of a predetermined number of detections by the temperature sensor. In this case, a predetermined number of detections used for the aforementioned averaging are set at a smaller value when the fixing roller is rotating, than when the fixing roller is not rotating. This arrangement makes it possible to conform to an abrupt change, and reduces the temperature ripple of the fixing roller having a high rate of temperature rise, whereby the fixing roller temperature can be stabilized within the range of the target fixing temperature.

(9) In the present invention described in Structure 9, the temperature calculation section calculates the temperature by averaging the results of a predetermined number of detections by the temperature sensor. In this case, a predetermined number of detections used for the aforementioned averaging are set at a smaller value when high power is supplied to the heating section, than when low power is supplied. This arrangement makes it possible to conform to an abrupt change, and reduces the temperature ripple of the fixing roller having a high rate of temperature rise, whereby the fixing roller temperature can be stabilized within the range of the target fixing temperature. Here the "high power" in the above-mentioned description can be defined as the higher power when a plurality of different powers are supplied to the fixing section, whereas the "low power" is the lower power in the same situation.

(10) In the present invention described in Structure 10, the first and second heating sections are heating units based on electromagnetic induction heating. Here the maximum power available for thermal fixing can be produced independently by either the first or second heating section. When the maximum available power for thermal fixing is supplied to either one of the first and second heating sections, power is not supplied to the other. To put it another way, the maximum power that can be supplied to the fixing roller can be supplied to either the first or second heating sections.

Thus, even in the case of a fixing roller having a high rate of temperature rise when the maximum power is supplied according to the electromagnetic induction heating method, this arrangement reduces the temperature ripple of the fixing roller having a high rate of temperature rise, whereby the fixing roller temperature can be stabilized within the range of the target fixing temperature.

What is claimed is:

1. An image forming apparatus, comprising:

a fixing section which fixes a toner image on a recording medium;

a heating section which heats the fixing section;

a temperature detecting section, which has a thermal response characteristic, and which detects a temperature of the fixing section; and a control section which controls power supply to the heating section based on the temperature of the fixing section detected by the temperature detecting section, so that the temperature of the fixing section reaches a target fixing temperature, wherein after the control section starts power supply to the heating section, the control section stops power supply to the heating section, after a lapse of a predetermined time interval, based on the thermal response characteristic of the temperature detecting section, even when the temperature of the fixing section has not yet reached the target fixing temperature.

2. The image forming apparatus in claim 1, wherein the heating section comprises:

a first heating section which heats a central area of the fixing section; and second heating sections which heat both ends of the fixing section;

wherein the temperature detecting section comprises:

a first temperature detecting section, which has a thermal response characteristic, and which detects a first temperature at the central area of the fixing section; and a second temperature detecting section, which has a thermal response characteristic equivalent to the thermal response characteristic of the first temperature detecting section, and which detects a second temperature of one of the ends of the fixing section; and wherein the control section stops power supply to the first and second heating sections based on the thermal response characteristic of the first and second temperature detecting sections.

3. The image forming apparatus in claim 2, wherein a first power supply time period, from starting power supply to the first heating section to stopping the power supply, is determined based on the thermal response characteristic of the first temperature detecting section, and a second power supply time period, from starting power supply to the second heating section to stopping the power supply, is determined based on the thermal response characteristic of the second temperature detecting section;

wherein the fixing section comprises a rotatable fixing member; and wherein the first power supply time period is set based on whether or not the fixing member is rotating, and the second power supply time period is set based on whether or not the fixing member is rotating.

4. The image forming apparatus in claim 2, wherein each of the first and second heating sections comprises an electromagnetic induction heating unit, and each of the first and second heating sections is independently capable of producing a maximum power available for thermal fixing; and wherein when a maximum electric power available for thermal fixing is supplied to either one of the first and second heating sections alone, the control section does not supply electric power to the other heating section.

5. The image forming apparatus in claim 1, wherein a warm-up operation of warming-up the fixing section is terminated when the temperature detecting section detects that the fixing section has reached a warm-up termination temperature, and the warm-up termination temperature is set lower than the target fixed temperature.

6. The image forming apparatus in claim 1, wherein the temperature detecting section comprises:

an infrared temperature sensor which detects infrared rays radiated from the fixing section;

a temperature correction sensor which detects a temperature around the infrared temperature sensor; and a temperature calculation section which calculates the temperature of the fixing section based on a result of detection by the infrared temperature sensor and a result of detection by the temperature correction sensor.

7. The image forming apparatus in claim 6, wherein the temperature calculation section calculates the temperature of the fixing section based on: (i) an average of results of a first predetermined number of detections obtained by reading the infrared temperature sensor at certain intervals and (ii) an average of results of a second predetermined number of detections obtained by reading the temperature correction sensor at certain intervals;

wherein the fixing section comprises a rotatable fixing member; and wherein each of the first predetermined number of detections and the second predetermined number of detections is set at a smaller value when the fixing member is rotating, than when the fixing member is not rotating.

8. The image forming apparatus in claim 6, wherein the temperature calculation section calculates the temperature of the fixing section based on: (i) an average of results of a first predetermined number of detections obtained by reading the infrared temperature sensor at certain intervals and (ii) an average of results of a second predetermined number of detections obtained by reading the temperature correction sensor at certain intervals; and wherein each of the first predetermined number of detections and the second predetermined number of detections is set at a smaller value when high power is supplied to the heating section, than when low power is supplied.

9. An image forming apparatus comprising:

a fixing section which fixes a toner image on a recording medium;

a heating section which heats the fixing section;

a temperature detecting section, which has a thermal response characteristic, and which detects a temperature of the fixing section; and a control section which controls power supply to the heating section based on the temperature of the fixing section detected by the temperature detecting section, so that the temperature of the fixing section reaches a target fixing temperature;

wherein after the control section starts power supply to the heating section, the control section reduces power supply to the heating section, based on the thermal response characteristic of the temperature detecting section, even when the temperature of the fixing section has not yet reached the target fixing temperature, and stops power supply to the heating section, when the temperature of the fixing section has reached the target fixing temperature.

10. The image forming apparatus in claim 9, wherein the heating section comprises:

a first heating section which heats a central area of the fixing section; and second heating sections which heat both ends of the fixing section; and wherein the temperature detecting section comprises:

a first temperature detecting section, which has a thermal response characteristic, and which detects a first temperature at the central area of the fixing section; and a second temperature detecting section, which has a thermal response characteristic equivalent to the thermal response characteristic of the first temperature detecting section, and which detects a second temperature of one of the ends of the fixing section; and wherein after the control section starts power supply to the first and second heating sections, the control section reduces power supply to the first and second heating sections, based on the thermal response characteristic of the first and second temperature detecting sections, even when each temperature of the first and second heating sections has not yet reached the target fixing temperature, and the control section stops power supply to the first and second heating sections, when each temperature of the first and second heating sections has reached the target fixing temperature.

11. The image forming apparatus in claim 10, wherein a first power supply time period, from starting power supply to the first heating section to stopping the power supply, is determined based on the thermal response characteristic of the first temperature detecting section, and a second power supply time period, from starting power supply to the second heating section to stopping the power supply, is determined based on the thermal response characteristic of the second temperature detecting section;

wherein the fixing section comprises a rotatable fixing member; and wherein the first power supply time period is set based on whether or not the fixing member is rotating, and the second power supply time period is set based on whether or not the fixing member is rotating.

12. The image forming apparatus in claim 10, wherein each of the first and second heating sections comprises an electromagnetic induction heating unit, and each of the first and second heating sections is independently capable of producing a maximum power available for thermal fixing; and wherein when a maximum electric power available for thermal fixing is supplied to either one of the first and second heating sections alone, the control section does not supply electric power to the other heating section.

13. The image forming apparatus in claim 9, wherein a warm-up operation of warming-up the fixing section is terminated when the temperature detecting section detects that the fixing section has reached a warm-up termination temperature, and the warm-up termination temperature is set lower than the target fixed temperature.

14. The image forming apparatus in claim 9, wherein the temperature detecting section comprises:

an infrared temperature sensor which detects infrared rays radiated from the fixing section;

a temperature correction sensor which detects a temperature around the infrared temperature sensor; and a temperature calculation section which calculates the temperature of the fixing section based on a result of detection by the infrared temperature sensor and a result of detection by the temperature correction sensor.

15. The image forming apparatus in claim 14, wherein the temperature calculation section calculates the temperature of the fixing section based on: (i) an average of results of a first predetermined number of detections obtained by reading the infrared temperature sensor at certain intervals and (ii) an average of results of a second predetermined number of detections obtained by reading the temperature correction sensor at certain intervals;

wherein the fixing section comprises a rotatable fixing member; and wherein each of the first predetermined number of detections and the second predetermined number of detections is set at a smaller value when the fixing member is rotating, than when the fixing member is not rotating.

16. The image forming apparatus in claim 14, wherein the temperature calculation section calculates the temperature of the fixing section based on: (i) an average of results of a first predetermined number of detections obtained by reading the infrared temperature sensor at certain intervals and (ii) an average of results of a second predetermined number of detections obtained by reading the temperature correction sensor at certain intervals; and wherein each of the first predetermined number of detections and the second predetermined number of detections is set at a smaller value when high power is supplied to the heating section, than when low power is supplied.

* * * * *